US011627844B2

(12) United States Patent
Derr

(10) Patent No.: US 11,627,844 B2
(45) Date of Patent: Apr. 18, 2023

(54) FOOT WASH APPARATUS

(71) Applicant: Chris Derr, Chandler, AZ (US)

(72) Inventor: Chris Derr, Chandler, AZ (US)

( * ) Notice: Subject to any disclaimer, the term of this patent is extended or adjusted under 35 U.S.C. 154(b) by 469 days.

(21) Appl. No.: 16/935,916

(22) Filed: Jul. 22, 2020

(65) Prior Publication Data

US 2021/0030217 A1 Feb. 4, 2021

Related U.S. Application Data

(60) Provisional application No. 62/877,706, filed on Jul. 23, 2019.

(51) Int. Cl.

| | |
|---|---|
| ***A47K 7/04*** | (2006.01) |
| ***A46B 11/00*** | (2006.01) |
| ***A46B 15/00*** | (2006.01) |

(52) U.S. Cl.

CPC ..... *A47K 7/043* (2013.01); *A46B 11/0017* (2013.01); *A46B 11/0065* (2013.01); *A46B 15/0097* (2013.01); *A46B 2200/1006* (2013.01)

(58) Field of Classification Search

CPC . A47K 7/02; A47K 7/026; A47K 7/04; A46B 15/0097; A46B 11/0017

USPC ..... 15/104.92

See application file for complete search history.

(56) References Cited

U.S. PATENT DOCUMENTS 4,532,668 A 8/1985 Slonicki

FOREIGN PATENT DOCUMENTS

BR PI0901099 A2 * 12/2010 ..... A61H 35/00

* cited by examiner

*Primary Examiner* — Michael D Jennings
*Assistant Examiner* — Aaron R McConnell
(74) *Attorney, Agent, or Firm* — Parsons & Goltry; Robert A. Parsons; Michael W. Goltry

(57) ABSTRACT

Foot washing apparatus including a base, a housing with a first arm extending vertically from the base so as to generally divide an upper surface of the base into a toe area and a heel area, and a second arm having a lower surface extending generally horizontally from the first arm, the lower surface of the second arm overlying the toe area. A soap dispensing assembly includes a receptacle for receiving a pressurized soap can, an activating lever for dispensing soap, a conduit system for carrying dispensed soap from the soap can to brushes carried by the apparatus, and a stabilizing handle extending upwardly form the base. A trigger mechanism is carried by a grip and coupled to the activating lever by a link for moving the activating lever to the activated position.

19 Claims, 3 Drawing Sheets

FOOT WASH APPARATUS

CROSS-REFERENCE TO RELATED APPLICATIONS

This application claims the benefit of U.S. Provisional Patent Application No. 62/877,706, filed 23 Jul. 2019.

FIELD OF THE INVENTION

This invention relates to apparatus for washing, and more particularly to apparatus for washing the feet of humans.

BACKGROUND OF THE INVENTION

One of the major concerns in care of the human body is to maintain healthy feet. Since healthy feet help to keep a person ambulatory and since movement, e.g. walking, running, etc., is necessary to maintain the rest of the body healthy, it is clear that healthy feet are critical for maintaining a healthy body. Often, washing feet by hand in a shower can be cumbersome, difficult or impossible for some people, such as the handicapped, obese, old, injured, or post-surgery. Additionally, for some people this is not simply inconvenient, but can be dangerous due to slips and falls and the like.

Because human feet are normally encased in shoes and socks, they can perspire a great deal and the continual dampness can result in various foot fungus and diseases. When shoes are not worn, feet become dirty from the environment and are exposed to bacteria and infection. Thus, regular and proper cleaning or washing is critical to healthy feet. However, many people either cannot or do not wash their feet regularly or properly.

Brushes have been used through the years to wash feet. Some of these are placed on the floor to scrub feet on. The problem with these brushes is that many individuals cannot balance well on one foot while scrubbing the other, and the brushes tend to slide on the floor when used. Additionally, these brushes retain water and become moldy and unusable very quickly.

It would be highly advantageous, therefore, to remedy the foregoing and other deficiencies inherent in the prior art.

Accordingly, it is an object of the present invention to provide new and improved foot washing apparatus and procedures.

It is another object of the present invention to provide new and improved foot washing apparatus that is convenient to use for virtually any person, removing the need for bending to either wash the foot or apply soap.

Yet another object of the present invention is to provide a foot washing apparatus that provides stability to the user and the device.

SUMMARY OF THE INVENTION

Briefly, to achieve the desired objects and advantages of the instant invention provided is foot washing apparatus including a base having an upper surface and a lower surface and a housing. The housing includes a first arm extending generally vertically from the base so as to generally divide the upper surface of the base into a toe area and a heel area. A second arm has a lower surface extending generally horizontally from the first arm, the lower surface of the second arm is substantially parallel with, spaced apart from and overlying the toe area of the upper surface of the base. A lower toe brush is affixed to the upper surface of the base in the toe area. An upper toe brush is affixed to the lower surface of the second arm and overlying the lower toe brush. A heel brush is affixed to the upper surface of the base in the heel area. A soap dispensing assembly is carried by the second arm and includes a receptacle for receiving a pressurized soap can and an activating lever for receiving a nozzle of the pressurized soap can. The activating lever is movable between an activated position for dispensing soap and a non-activated position. A conduit system is couplable to the pressurized can at the receptacle for carrying dispensed soap from the soap can to the upper toe brush and the heel brush. A stabilizing handle extends upwardly form the base. The stabilizing handle includes an elongated tubular element with a grip attached to an upper end and a lower end rigidly and immovably coupled to the base. The tubular element is sufficiently rigid so that force can be applied downwardly to the base therethrough by a user to firmly hold the base in place during use and to provide a balance and stability facilitator to the user. A trigger mechanism is carried by the grip of the stabilizing handle, the trigger mechanism is coupled to the activating lever by a link extending through the tubular element. The trigger mechanism is movable between a raised position, moving activating lever to the activated position for dispensing soap, and a lowered position, moving activating lever to the non-activated position.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF THE DRAWINGS

Figure 1:
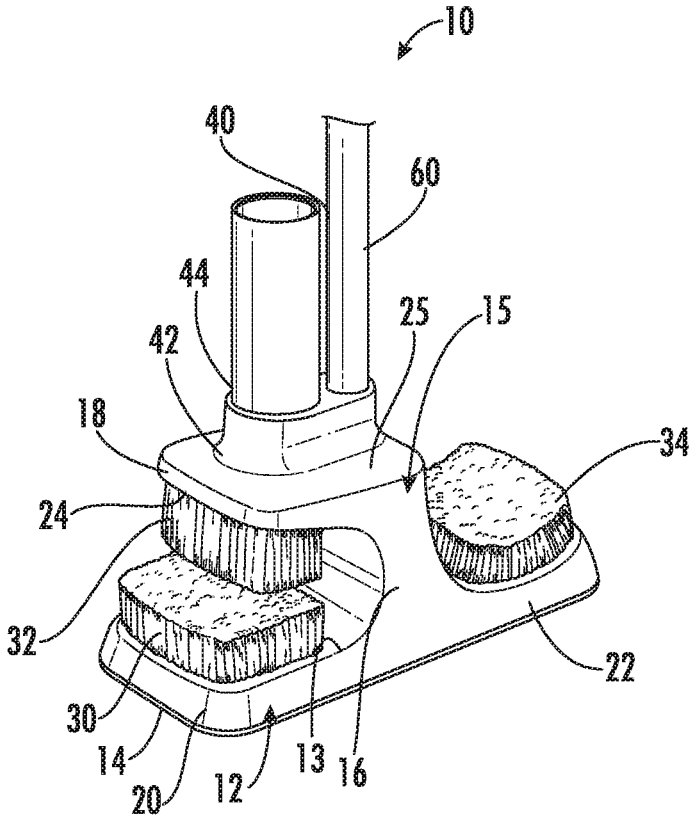
FIG. 1 is a perspective top view of foot washing apparatus according to the present invention.

Turning now to the drawings in which like reference characters indicate corresponding elements throughout the several views, attention is directed to FIG. 1 which illustrates foot washing apparatus 10 in accordance with the present invention. It should be understood that apparatus 10 is simply one possible configuration being used as an example of the invention and many modifications and/or alterations are possible. Apparatus 10 includes a base 12, having an upper surface 13 and a lower surface 14, designed to be positioned flat on a floor or the like to form a sturdy rigid platform for the foot washing procedure. An inverted L-shaped housing 15 is positioned with a first arm 16 extending vertically and a second arm 18 extending horizontally from first arm 16 generally parallel with and spaced apart from upper surface 13 of base 12. The lower end of first arm 16 extends from upper surface 13 of base 12. Arm 16 can be formed integrally with, or as a separate piece attached to base 12. Vertically extending first arm 16 extends from base 12 so as to generally divide upper surface 13 into a toe area 20 and a heel area 22. Second arm 18 overlies and is spaced apart from toe area 20 of base 12. Second arm 18 includes a lower surface 24 generally opposing and spaced apart from upper surface 13 at toe area 20 of base 12. Second arm 18 also supports a soap dispensing assembly on an upper surface 25, thereof, as will be described presently.

A lower toe brush 30 is affixed to upper surface 13 of base 12 in toe area 20. An upper toe brush 32 is affixed to a lower surface 24 of second arm 18 of housing 15. Lower toe brush 30 and upper toe brush 32 are positioned to form a general clam-shell formation designed to receive the toes of a human foot therebetween for brushing the tops of the toes (and, generally, adjacent portion of the foot) and the bottoms of the toes simultaneously. Generally, brushes 30 and 32 have sufficiently long and flexible fibers to reach between the toes so as to provide a complete scrubbing action.

A heel brush 34 is affixed to upper surface 13 of heel area 22. Brush 34 has a slightly concaved formation so as to receive a heel thereon and brush not only the bottom but at least partially along the sides. The fibers of brush 34 can be much stiffer than the fibers of brushes 30 and 32 since they only have to brush the surface of the heel and since the skin of the heel is notorious for flaking, etc.

Figure 4:
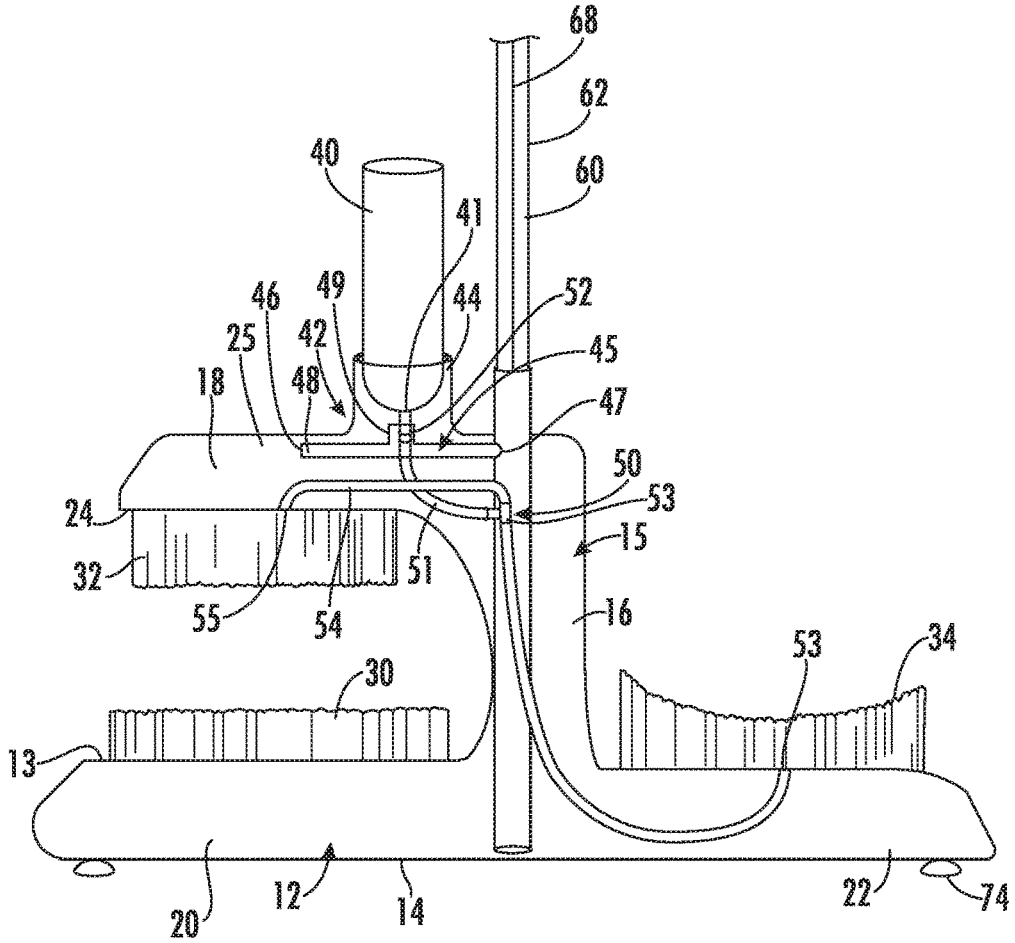
FIG. 4 is a sectional side view of foot washing apparatus according to the present invention.

With Additional reference to FIG. 4, a replaceable pressurized foaming soap can 40 is mounted to a soap dispensing assembly 42 carried by upper surface 25 of housing 15. Soap can 40 is inverted and received in a receptacle 44 of soap dispensing assembly 42 so as to be held firmly in place, with a nozzle 41 thereof extending downwardly therefrom. Assembly 42 includes an activating lever 45 movable between an activated position and a non-activated position. Activating lever 45 has a distal end 46 and a proximal end 47. Distal end 46 is fixed in position for pivotal movement about pivot point 48, while proximal end 47 is movable between a raised position (activated position of the activating lever), and a lowered position (non-activated position of the activating lever). A socket 49 is carried by activating lever 45 intermediate distal end 46 and proximal end 47. Socket 49 is positioned underlying receptacle 44 for receipt of nozzle 41 therein. With proximal end 47 in the normal lowered position, nozzle 41 of soap can 40 positioned in receptacle 44 is in a closed position (non-activated position of the activating lever). Movement of proximal end 47 to the raised position correspondingly moves socket 49, activating nozzle 41 to an open position (activated position of the activating lever). In the open position, also referred to as the activated position of the activating lever, soap is dispensed from can 40 into internal conduit system 50. In the preferred embodiment, conduit system 50 includes a main conduit 51 having an end coupled to a fitting 52 carried by socket 49. Fitting 52 couples the end of main conduit 51 to nozzle 41 (when can 40 is in receptacle 44) to allow movement of soap from can 40 into conduit system 50. An opposing end of main conduit 51 is coupled to a manifold 53 for diverting dispensed soap to the various brushes. A toe conduit 54 is coupled between manifold 53 and an aperture 55 located in lower surface 24 at the base of brush 32. A heel conduit 56 is coupled between manifold 53 and an aperture 57 located in upper surface 13 at the base of brush 34. Thus, soap is carried from soap can 40, when activated, to brush 32 and brush 34. It will be understood that an additional conduit can be used to carry soap to brush 30 if desired.

Figure 2:
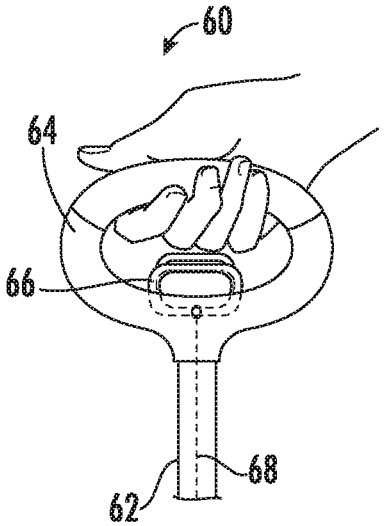
FIG. 2 is a perspective side view of an operating handle portion of the foot washing apparatus of FIG. 1, broken away to show operation thereof.
Figure 3:
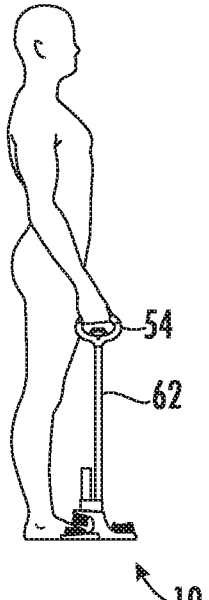
FIG. 3 is a perspective side view of a human washing his feet using the foot washing apparatus of FIG. 1.

Assembly 42 also firmly attaches a stabilizing handle 60 to housing 15 and base 12. With additional reference to FIG. 2, the upper end of stabilizing handle 60 is illustrated in detail. As can be seen from FIGS. 1, 2 and 3, handle 60 includes an elongated tubular element 62 with a grip 64 attached to the upper end. Tubular element 62 is of a convenient height so that grip 64 can be gripped while in a comfortable standing position as can be seen in FIG. 3. To this end tubular element 62 can be of a standard length or it can be variable, e.g. telescoping, etc. Handle 60 is sufficiently rigid so that pressure can be applied to base 12 therethrough by the user. The application of pressure through handle 60 functions to firmly hold base 12 in place as a foot is moved through brushes 30 and 32 or over brush 34, and provides a balance and stability facilitator to the user. Handle 60 also includes a trigger mechanism 66 as part of soap dispensing assembly 42. Trigger mechanism 66 is movable between a raised position and a lowered position. Trigger mechanism 66 is coupled to proximal end 47 of activating lever 45 by a link 68 which extends through tubular element 62. Link 68 can be a stiff rod, but is preferably a flexible link such as wire, cable, chain, string and the like. While normally in the lowered position, when trigger mechanism 66 is move to the raised position, link 68 moves proximal end 47 to the raised position which correspondingly moves socket 49, activating nozzle 41 to an open position and dispensing soap through conduit system 50 to brushes 32 and 34.

Figure 5:
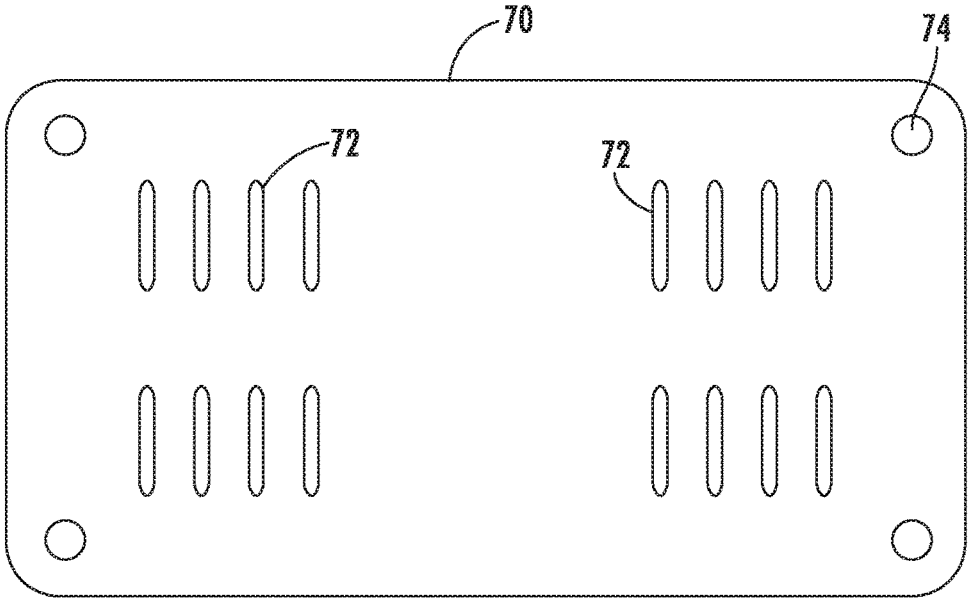
FIG. 5 is a bottom plan view of foot washing apparatus.
Figure 6:
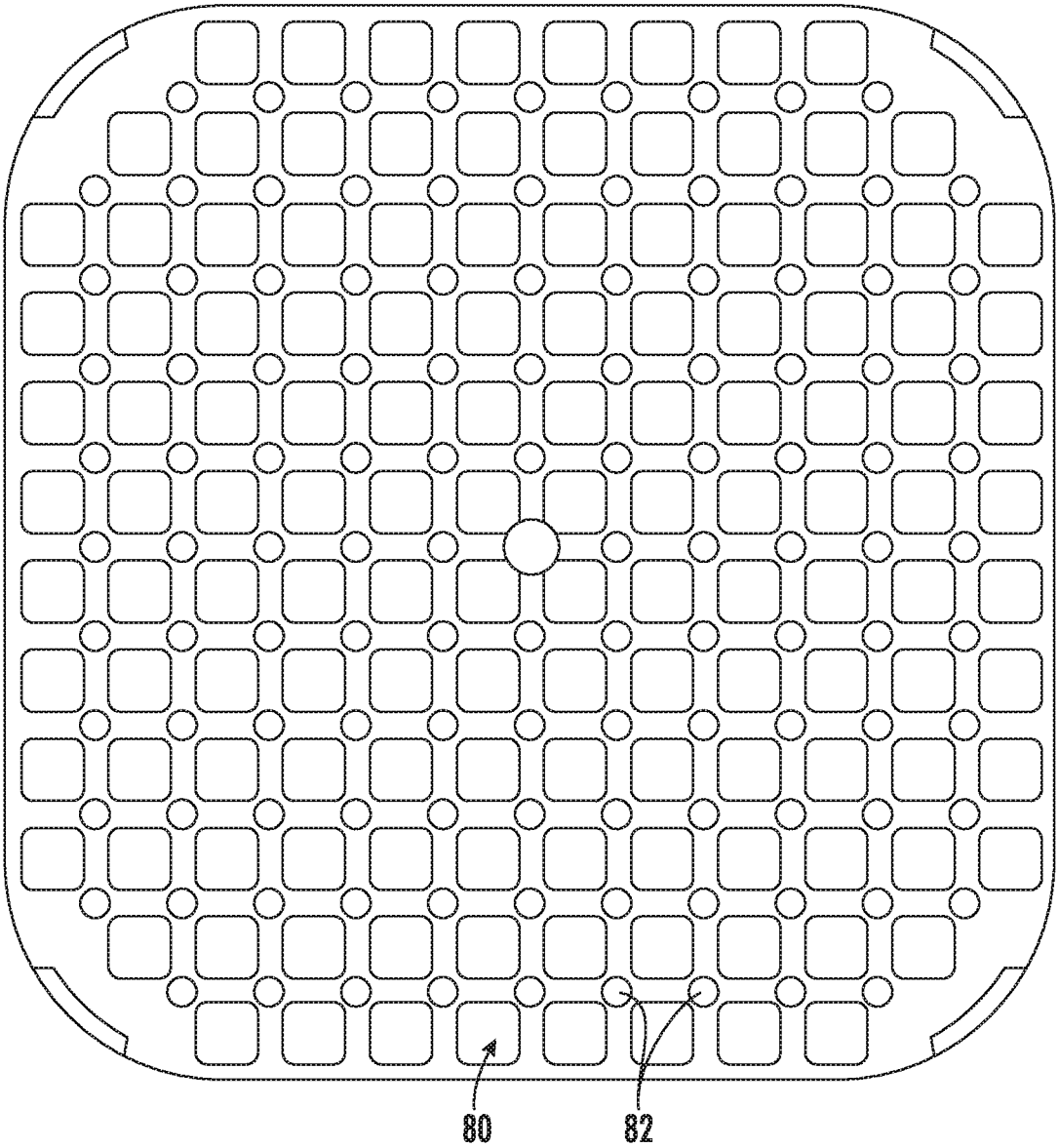
FIG. 6. is a top view of the base of a brush according to the present invention.

Turning now to FIG. 5, lower surface 14 of base 12 is preferably a plate 70 having slots 72 or other perforations therethrough underlying brushes 30 and 34. These perforation permit water to flow directly from the top, through brushes 30 and 34 and drain quickly out the bottom carrying dirt and soap away. With reference to FIG. 6, a bottom view of a base 80 of brush 30, is illustrated, showing a plurality of holes 82 formed therethrough between bristle. Base 80 is positioned directly above slots 72, allowing water to pass directly through from top to bottom. This increases cleaning ability and keeps apparatus 10 clean. Feet 73 are mounted on the corners to provide a stable base and to provide a gap between a floor and plate 70, allowing free flow of water therethrough. The ability of apparatus 10 to drain water quickly helps prevent mold and mildew from forming on the apparatus.

In the preferred operation of foot washing apparatus 10 and referring additionally to FIG. 3, a user firmly grips grip 64 and dispenses soap from soap can 40 by operating trigger mechanism 66. The user then moves his toes between brushes 30 and 32 and moves the toes either into and out of contact with brushes 30 and 32 such as from side to side through brushes 30 and 32. Generally, it has been found that moving the toes both forward and backward and from side-to-side provides a superior cleaning result. Once the toes are sufficiently clean, the heel can be vigorously moved over brush 34 in different directions to clean all surfaces of the heel (e.g. the bottom and partially up the sides). It will be understood of course that the specific steps can be reversed or interleaved if desired.

Once the foot is sufficiently clean, it can be rinsed by simply placing it in the shower stream. Typically, the apparatus 10 is placed in the shower stream to provide water for the cleansing operation to wash and rinse the feet. With one foot completed, the user can perform the same procedure on the other foot. Because the foot being cleaned will be soapy and very slippery, it is preferred that the user complete one foot at a time.

Thus, a new and improved foot washing apparatus and procedure is disclosed for use by anyone including people who may not be able to conveniently reach their feet. A major advantage in the novel foot washing apparatus is that there is no need for the user to bend or otherwise contact the feet with their hands, and the apparatus is stable and provides stability to the user for safe use. Also, the brushes perform a superior cleaning procedure over simply rubbing the feet with a cloth or by hand. The new and improved foot washing apparatus and procedure greatly improves a person's foot washing capabilities whether that person can conveniently reach their feet or not. Further, because the feet can be quickly and easily cleaned, it is believed that the person will remain ambulatory longer into life and, therefore, healthier, longer.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

Having fully described the invention in such clear and concise terms as to enable those skilled in the art to understand and practice the same, the invention claimed is:

1. Foot washing apparatus comprising:

a base having an upper surface and a lower surface;

a housing including:

a first arm extending generally vertically from the base so as to generally divide the upper surface of the base into a toe area and a heel area; and a second arm having a lower surface extending generally horizontally from the first arm, the lower surface of the second arm being substantially parallel with, spaced apart from and overlying the toe area of the upper surface of the base;

a lower toe brush affixed to the upper surface of the base in the toe area;

an upper toe brush affixed to the lower surface of the second arm and overlying the lower toe brush;

a heel brush affixed to the upper surface of the base in the heel area;

a soap dispensing assembly carried by the second arm, the soap dispensing assembly including:

a receptacle for receiving a pressurized soap can;

an activating lever for receiving a nozzle of the pressurized soap can, the activating lever movable between an activated position for dispensing soap and a non-activated position; and a conduit system couplable to the pressurized can at the receptacle for carrying dispensed soap from the soap can to the upper toe brush and the heel brush;

a stabilizing handle extending upwardly form the base, the stabilizing handle including an elongated tubular element with a grip attached to an upper end and a lower end rigidly and immovably coupled to the base, the tubular element being sufficiently rigid so that force can be applied downwardly to the base therethrough by a user to firmly hold the base in place during use and to provide a balance and stability facilitator to the user; and a trigger mechanism carried by the grip of the stabilizing handle, the trigger mechanism coupled to the activating lever by a link extending through the tubular element, the trigger mechanism being movable between a raised position, moving activating lever to the activated position for dispensing soap and a lowered position, moving activating lever to the non-activated position.

2. The foot washing apparatus as claimed in claim 1 wherein the activating lever further comprises:

a distal end fixed in position for pivotal movement about pivot point;

a proximal end coupled to the link and movable between a raised position and a lowered position;

a socket carried by the activating lever intermediate the distal end and the proximal end, the socket underlying the receptacle for receipt of the nozzle of the pressurized soap can therein.

3. The foot washing apparatus as claimed in claim 1 wherein the conduit system further comprises:

a main conduit having an end couplable to the nozzle through the activating lever and an opposing end coupled to a manifold;

a toe conduit coupled between the manifold and an aperture located in the lower surface of the second arm at a base of the upper toe brush;

a heel conduit coupled between the manifold and an aperture located in the upper surface of the base at the heel area at a base of the heel brush.

4. The foot washing apparatus as claimed in claim 1 wherein the conduit system further includes a fitting carried by the socket for coupling the end of the main conduit to the nozzle to allow movement of soap from the pressurized soap can into the conduit system.

5. The foot washing apparatus as claimed in claim 1 wherein the base further includes a plate having a plurality of perforation formed therethrough.

6. The foot washing apparatus as claimed in claim 5 wherein the plurality of perforation formed in the plate are formed underlying the toe area and the heel area.

7. The foot washing apparatus as claimed in claim 6 wherein the lower toe brush and the heel brush each include a base having a plurality of holes formed therethrough overlying the plurality of perforations.

8. Foot washing apparatus comprising:

a base having an upper surface and a lower surface;

a housing including:

a first arm extending generally vertically from the base so as to generally divide the upper surface of the base into a toe area and a heel area; and a second arm having a lower surface extending generally horizontally from the first arm, the lower surface of the second arm being substantially parallel with, spaced apart from and overlying the toe area of the upper surface of the base;

a lower toe brush affixed to the upper surface of the base in the toe area;

an upper toe brush affixed to the lower surface of the second arm and overlying the lower toe brush;

a heel brush affixed to the upper surface of the base in the heel area;

a soap dispensing assembly carried by the second arm, the soap dispensing assembly including:

a receptacle formed in the second arm;

a pressurized soap can having a nozzle, the pressurized can received in the receptacle;

an activating lever receiving the nozzle of the pressurized soap can, the activating lever carried by the second arm and movable between an activated position for dispensing soap and a non-activated position; and a conduit system coupled to the pressurized can, the conduit system including a main conduit having an end coupled to the nozzle through the activating lever and an opposing end coupled to a manifold, a toe conduit coupled between the manifold and an aperture located in the lower surface of the second arm at a base of the upper toe brush and a heel conduit coupled between the manifold and an aperture located in the upper surface of the base in the heel area at a base of the heel brush;

a stabilizing handle extending upwardly form the base, the stabilizing handle including an elongated tubular element with a grip attached to an upper end and a lower end rigidly and immovably coupled to the base, the tubular element being sufficiently rigid so that force can be applied downwardly to the base therethrough by a user to firmly hold the base in place during use and to provide a balance and stability facilitator to the user; and a trigger mechanism carried by the grip of the stabilizing handle, the trigger mechanism coupled to the activating lever for moving the activating lever between the activated position for dispensing soap and the non-activated position.

9. The foot washing apparatus as claimed in claim 8 wherein the activating lever further comprises:

a distal end fixed in position for pivotal movement about a pivot point;

a proximal end movable between a raised position and a lowered position;

a socket carried by the activating lever intermediate the distal end and the proximal end, the socket underlying the receptacle and receiving the nozzle of the pressurized soap can therein.

10. The foot washing apparatus as claimed in claim 9 wherein the conduit system further includes a fitting carried by the socket, the fitting couples the end of the main conduit to the nozzle of the pressurized soap can to allow movement of soap from the pressurized soap can into the conduit system.

11. The foot washing apparatus as claimed in claim 9 wherein the soap dispensing assembly further comprises a link coupled between the trigger mechanism and the proximal end of the activating lever, the link extending through the tubular element.

12. The foot washing apparatus as claimed in claim 8 wherein the base further includes a plate having a plurality of perforation formed therethrough.

13. The foot washing apparatus as claimed in claim 12 wherein the plurality of perforation formed in the plate are formed underlying the toe area and the heel area.

14. The foot washing apparatus as claimed in claim 13 wherein the lower toe brush and the heel brush each include a base having a plurality of holes formed therethrough overlying the plurality of perforations.

15. Foot washing apparatus comprising:

a base having an upper surface and a lower surface;

a housing including:

a first arm extending generally vertically from the base so as to generally divide the upper surface of the base into a toe area and a heel area; and a second arm having a lower surface extending generally horizontally from the first arm, the lower surface of the second arm being substantially parallel with, spaced apart from and overlying the toe area of the upper surface of the base;

a lower toe brush affixed to the upper surface of the base in the toe area;

an upper toe brush affixed to the lower surface of the second arm and overlying the lower toe brush;

a heel brush affixed to the upper surface of the base in the heel area;

a soap dispensing assembly carried by the second arm, the soap dispensing assembly including:

a receptacle for receiving a pressurized soap can;

an activating lever for receiving a nozzle of the pressurized soap can, the activating lever movable between an activated position for dispensing soap and a non-activated position, the activating lever including a distal end fixed in position for pivotal movement about a pivot point, a proximal end movable between a raised position and a lowered position and, a socket carried by the activating lever intermediate the distal end and the proximal end, the socket underlying the receptacle for receiving the nozzle of the pressurized soap can therein; and a conduit system couplable to the pressurized can, the conduit system including a main conduit having an end couplable to the nozzle through the activating lever and an opposing end coupled to a manifold, a toe conduit coupled between the manifold and an aperture located in the lower surface of the second arm at a base of the upper toe brush and a heel conduit coupled between the manifold and an aperture located in the upper surface of the base in the heel area at a base of the heel brush;

a stabilizing handle extending upwardly form the base, the stabilizing handle including an elongated tubular element with a grip attached to an upper end and a lower end rigidly and immovably coupled to the base, the tubular element being sufficiently rigid so that force can be applied downwardly to the base therethrough by a user to firmly hold the base in place during use and to provide a balance and stability facilitator to the user; and a trigger mechanism carried by the grip of the stabilizing handle, a link coupled between the trigger mechanism and the proximal end of the activating lever, the trigger mechanism being movable between a raised position, moving activating lever to the activated position for dispensing soap and a lowered position, moving activating lever to the non-activated position.

16. The foot washing apparatus as claimed in claim 15 wherein the conduit system further includes a fitting carried by the socket, the fitting is for coupling the end of the main conduit to the nozzle of the pressurized soap can to allow movement of soap from the pressurized soap can into the conduit system.

17. The foot washing apparatus as claimed in claim 15 wherein the base further includes a plate having a plurality of perforation formed therethrough.

18. The foot washing apparatus as claimed in claim 17 wherein the plurality of perforation formed in the plate are formed underlying the toe area and the heel area.

19. The foot washing apparatus as claimed in claim 18 wherein the lower toe brush and the heel brush each include a base having a plurality of holes formed therethrough overlying the plurality of perforations.

* * * * *